US009653245B2

(12) United States Patent
Reiter et al.

(10) Patent No.: US 9,653,245 B2
(45) Date of Patent: May 16, 2017

(54) TEMPERATURE SWITCH AND METHOD FOR ADJUSTING A TEMPERATURE SWITCH

(71) Applicants: Werner Reiter, Klosterneuberg (AT); Peter Klaus Soukup, Gramatneusiedl (AT); Josef Reithofer, Wolfpassing (AT)

(72) Inventors: Werner Reiter, Klosterneuberg (AT); Peter Klaus Soukup, Gramatneusiedl (AT); Josef Reithofer, Wolfpassing (AT)

( * ) Notice: Subject to any disclaimer, the term of this patent is extended or adjusted under 35 U.S.C. 154(b) by 89 days.

(21) Appl. No.: 14/417,770

(22) PCT Filed: Jul. 30, 2013

(86) PCT No.: PCT/EP2013/066042

§ 371 (c)(1),
(2) Date: Jan. 27, 2015

(87) PCT Pub. No.: WO2014/020045

PCT Pub. Date: Feb. 6, 2014

(65) Prior Publication Data

US 2015/0206687 A1 Jul. 23, 2015

(30) Foreign Application Priority Data

Jul. 31, 2012 (DE) ..... 10 2012 106 978

(51) Int. Cl.

| | |
|---|---|
| ***H01H 69/01*** | (2006.01) |
| ***H01H 61/01*** | (2006.01) |
| ***H01H 37/04*** | (2006.01) |
| ***H01H 37/12*** | (2006.01) |
| ***H01H 37/28*** | (2006.01) |
| ***H01H 37/30*** | (2006.01) |
| ***H01H 61/04*** | (2006.01) |

(52) U.S. Cl.

CPC ..... *H01H 61/01* (2013.01); *H01H 37/04* (2013.01); *H01H 37/12* (2013.01); *H01H 37/28* (2013.01); *H01H 37/30* (2013.01); *H01H 61/04* (2013.01)

(58) Field of Classification Search

USPC ..... 337/347

See application file for complete search history.

(56) References Cited

U.S. PATENT DOCUMENTS 3,416,115 A * 12/1968 Moorhead ..... H01H 37/54 337/343
3,768,057 A * 10/1973 Sekira ..... H01H 37/54 337/349

(Continued)

FOREIGN PATENT DOCUMENTS

| | | |
|---|---|---|
| CN | 102779685 A | 11/2012 |
| DE | 24 02 656 A1 | 7/1974 |
| EP | 2 541 576 A1 | 1/2013 |

*Primary Examiner* — Anatoly Vortman
(74) *Attorney, Agent, or Firm* — Jason D. Voight

(57) ABSTRACT

The invention relates to a temperature switch comprising a housing (2), a switching system (3) consisting of a first support (3.1) with a fixed contact (3.2) and a second support (3.3), on which a switch spring (3.4) with a switch contact (3.5) is arranged and a switching arrangement (4), which effects a positional change of the switch contact (3.5) as a function of the temperature.

19 Claims, 2 Drawing Sheets

(56) References Cited

U.S. PATENT DOCUMENTS

| | | | | |
|---|---|---|---|---|
| 4,053,859 | A * | 10/1977 | Hollweck | H01H 37/5409 337/348 |
| 4,317,098 | A * | 2/1982 | Colavecchio | H01H 37/54 337/113 |
| 5,107,241 | A | 4/1992 | Ubukata et al. | |
| 6,580,351 | B2 * | 6/2003 | Davis | H01H 37/54 337/111 |
| 2001/0026207 | A1 | 10/2001 | Stenzel et al. | |
| 2013/0021132 | A1 * | 1/2013 | Kandhasamy | H01H 37/74 337/333 |
| 2013/0057381 | A1 * | 3/2013 | Kandhasamy | H01H 37/5409 337/348 |

* cited by examiner

TEMPERATURE SWITCH AND METHOD FOR ADJUSTING A TEMPERATURE SWITCH

This is the national stage of International Application PCT/EP2013/066042, filed Jul. 30, 2013.

The invention relates to a temperature switch and also a method for adjusting a temperature switch.

BACKGROUND OF THE INVENTION

Temperature switches already are sufficiently known from the prior art. They consist of a housing, in which a switching system and a switching arrangement actuating this switching system are provided. The switching system consists of a first and second support, wherein a position-invariant fixed contact, is arranged on the first support and a switch spring protruding from the support in a tongue-shaped manner with a switch contact provided thereon is arranged on the second support. The switching arrangement acts on the switch spring in such a manner that a positional change of the switch contact is effected as a function of the temperature. The switching arrangement is mostly formed by a bimetallic element, particularly a bimetallic disc, which is in operative connection with the switch spring via a switching element. The shape change of the bimetallic element effected by a temperature change is converted by means of the switching element into a positional change of the free end of the switch spring or the switch contact provided thereon, so that, depending on the shape of the bimetallic element, a temperature-dependent establishing or disconnecting of an electrical contact results.

In principle, there are two types of temperature switch, namely temperature switches that are termed "openers", which have a closed electrical contact at lower temperatures, for example room temperature, this electrical contact being opened only after a defined temperature threshold is exceeded. Furthermore, "closers" are also known, in which the electrical contact is open at low temperatures and the electrical contact is only closed after a defined temperature threshold is exceeded. A switch hysteresis is established both in the case of the temperature switches termed "openers" and temperature switches termed "closers", i.e. the switch over from a first switching state to a second switching state takes place at a different temperature value from the switch over back from the second to the first switching state. This is essentially because, for example in the case of an open contact, the spring force of the switch spring acts via the switching element on the bimetallic element and as a result, the temperature point of the switch over is shifted compared to the unloaded bimetallic element, i.e. a bimetallic element, which is not loaded by the spring force of the switch spring. In "openers", the bimetallic element is not loaded by the spring force of the switch spring in the case of a closed contact for example, as the switching element has a switch clearance with respect to the bimetallic element. Thus, in the case of a closed contact, there is an intermediate space between the bimetallic element and the switching element or the switch spring and the switching element.

A disadvantage of hitherto known temperature switches is the fact that the same are only unsatisfactorily adjustable with reference to the switching behaviour and switch hysteresis thereof and a satisfactorily precise adjustment can only be realised for one type of temperature switch in the case of predetermined temperature switch design, specifically either for an "opener" or a "closer".

BRIEF SUMMARY OF THE INVENTION

Taking this as a starting point, the problem to be solved by the invention is to provide a temperature switch, which can be adjusted optimally with regards to switch hysteresis or the switching behaviour compared to the prior art.

This problem is solved by the characterising features of the temperature switch described herein. A method for adjusting a temperature switch is also described herein.

The essential aspect of the temperature switch according to the invention consists in the fact that the first support and the second support are constructed in a bendable manner and that the housing is formed by at least one first housing section having at least one housing opening and a second housing section closing the housing opening, the housing opening being constructed for introducing and positioning adjustment means on the supports, that the housing opening is provided at the end of the first housing section accommodating the switching arrangement at least to some extent, and that the supports extend laterally into an interior formed in the first housing section. By constructing the temperature switch according to the invention, in each case an adjustment means can be positioned on a support and as a result, the supports can be bent in such a manner that a desired switching behaviour, particularly with reference to the desired switching point, at which a switch over from a closed electrical contact to an open electrical contact or vice versa takes place, or desired spring forces, which act on the bimetallic element and therefore on the switching behaviour, are achieved.

In a preferred embodiment, the switching arrangement is formed by a switching element and a shape changing bimetallic element. The positional change effected in certain sections by the shape change of the bimetallic element is thereby transferred to the switch spring or the switch contact by the switching element and thus effects contact closure or contact opening. Particularly preferably, the switching element is in operative connection with the bimetallic element and the switch spring in such a manner that a positional change of the switch contact takes place when the bimetallic element is deformed. Thus, the bimetallic element can be arranged spaced apart from the switch spring, for example at a position of the temperature switch, at which an optimised heat transfer to the bimetallic element can take place.

In a preferred embodiment, the first housing section is constructed in a U-shaped or essentially U-shaped manner. As a result, a housing region is created, in the interior of which the switching system can already be arranged or attached and can subsequently be adjusted or measured by means of an adjustment and measuring method. Preferably in this case, at least one face of the first housing section is used as a reference plane for the measurement, this reference plane being used after the measurement as a bearing surface or fixing surface for the switching arrangement or the second housing section accommodating or holding the switching arrangement. As a result, the plane used as reference plane during the measurement and adjustment procedure is used as a reference for the switching arrangement in the assembled state of the temperature switch.

Particularly preferably, the first housing section has two side sections located opposite to each other, on which one projection is formed in each case. The supports extending laterally into the interior of the housing can come to rest at least in certain sections against these projections and be supported on the same, so that a controlled bending of the supports during the adjustment is enabled.

Particularly preferably, the projections in each case have at least one projection face, running at right angles to the vertical axis of the temperature switch, and also a bending edge constructed thereon. This projection face is in this case used as a bearing surface for a portion of the respective support, wherein the support may subsequently be bent or permanently deformed around the bending edge. Thus, a controlled bending of the support is possible in case of an action of a bending force on the end of the support protruding with respect to the projection.

Particularly preferably, the first and second supports are in each case formed by a strip-shaped flat material with rectangular cross section with one pair of opposite, spaced apart wide and narrow sides in each case. The supports constructed in this manner are suitable, owing to the rectangular cross section, for rotationally secured passage through housing passages and for controlled bending by means of a large-area resting against the projection faces of the side sections of the first housing section.

Particularly preferably, the first and second supports are constructed in an angled manner in a first bending region and rest against the projection face of the projection via an intermediate section adjacent to the first bending region via a wide side in each case. By positive bending of the supports around the projection, particularly by means of a rectangular or essentially rectangular bending, a fixing of the respective support in the housing, particularly also in the case of the bending of the same, is achieved.

Particularly preferably, the first and second supports in each case have a second bending region adjoining the intermediate region, in which bending region the respective support is deformed in a bending direction different from the bending direction of the first bending region. In particular, in the second bending region a bending of the supports is achieved in the direction towards the housing opening, through which a measurement and adjustment arrangement for adjusting and measuring the temperature switch is introduced. As a result, the supports can be shaped back by the action of the adjustment means on the same in the direction of alignment of the support in the intermediate region, i.e. in a horizontal or essentially horizontal course and thus an adjustment of the temperature switch can be achieved without excessive, undesired displacement of the contact bearing points between the fixed contact and the switch contact.

Particularly preferably, the distance of the two mutually opposite free ends of the supports is smaller than the width of the housing opening measured in a plane perpendicular to the bending edges. As a result, the adjustment and measurement means can be guided via the housing opening onto the free ends of the supports, in order to bend the same or to position a measurement means on the switch spring running between the free ends of the supports, in order to measure the position thereof at the switch point with reference to a reference plane or the spring force thereof in the case of closed electrical contact or in the case of the opening of the electrical contact.

Particularly preferably, the switch contact and/or the fixed contact is constructed convexly curved on the contact surface. As a result, an excessive or undesired displacement of the contact bearing points can be prevented during bending of the supports, the contact surface, which produces the electrical contact, essentially always remaining the same, independently of the bending of the supports.

The invention furthermore relates to a method for adjusting a temperature switch, comprising a housing, a switching system consisting of a first support with a fixed contact and a second support, on which a switch spring with a switch contact is arranged. According to the invention, a first adjustment means acting on the first support and a second adjustment means acting on the second support are introduced via a housing opening, at least one of the supports being bent in an adjustment step by means of force action of the adjustment means on these supports and the position and/or the spring force of the switch spring being determined in a measurement step by means of a measurement means. Advantageously, as a result, during the adjustment method according to the invention, the position of the supports within the housing can initially be changed and subsequently in the measurement step, the change of the position of the switch spring or the spring force of the same in the open switching state or in the closed switching state can be measured and as a result, the switching point of the temperature switch can be determined in a defined manner.

Particularly preferably, before the initial bending of a support, the position of the switch spring at the switching point, at which a separation of the switch contact from the fixed contact takes place, is measured with reference to a reference plane by means of the measurement means. Additionally, the spring force of the switch spring is determined in the case of closed or in the case of open electrical contact. As a result, a recording of the actual values of the switching behaviour or the spring forces of the switch spring takes place at the beginning of the adjustment method. These are used in the further method as comparison values for how the position of the switch spring at the switching point or the spring forces have approximated desired values due to the adjustment of the supports.

Particularly preferably, in the adjustment step, the bending of a support or both supports around a bending edge takes place by lowering the respective adjustment means onto a section of the support protruding over the bending edge. Providing a bending edge enables an exact deformation of the support at a defined position and thus a reproducible deformation as a function of the force action or the displacement of the adjustment means with respect to the reference plane.

Particularly preferably, following one or a plurality of adjustment steps, a measurement step takes place in each case for measuring the position of the switch spring at the switching point and/or for measuring the spring force at the switching point and/or for measuring the spring force when the switch contact rests against the fixed contact. The change in the position of the switch spring or the spring forces effected by the preceding adjustment step can be detected by means of the measured values obtained by means of the measurement step and suitable parameters for the next adjustment procedure, particularly the degree of bending of one or both supports can be determined therefrom.

Particularly preferably, an iterative adjustment takes place by means of an alternating sequence of an adjustment step and a measurement step. As a result, a monitored and optimised adjustment of the temperature switch can be achieved using the lowest possible number of adjustment steps.

Particularly preferably, the bending of the at least one support in successive adjustment steps is differently sized, i.e. the degree of bending in successive adjustment steps may be suitably chosen as a function of the difference of the measured parameters from the desired values of these parameters, in order to achieve the lowest possible number of adjustment steps. So, for example, in the case of a large difference between the desired and actual values, a relatively large bending of the supports can be effected in the subsequent adjustment step, whereas in the case of only a small difference, the degree of bending is reduced.

Particularly preferably, the support(s) to be bent in the subsequent adjustment step and/or the degree of bending in the subsequent adjustment step are determined as a function of the change of the position of the switch spring and/or the spring force at the switching point. As a result, the adjustment method can be optimised as a function of the distance of the actual values determined in the previous measurement step from the desired values of the switching parameters in such a manner that the desired parameters of the switching point or the spring force at the switching point or in the case of a closed electrical contact are achieved with the smallest possible number of adjustment steps or measurement steps.

Particularly preferably, the adjustment of the temperature switch takes place to different switching element lengths. Thus, it is possible for example, in the case of a given temperature switch design, to undertake an optimisation to a defined value of a switching element length as a function of the values measured in the first measuring procedure, this switching element length being selected from a number of a plurality of discrete values of switching element lengths. Thus, an optimised switching behaviour can be achieved with a smaller number of adjustment steps, specifically in that, depending on the parameter set determined in the first measurement step, an optimised switching element length is determined and the bending of the supports subsequently takes place, taking this determined switching element length into account.

Particularly preferably, the measurement of the temperature switch takes place by means of the action of the measurement means on a switching element located in the housing, the switching element acting on the switch spring. Here, the production tolerance of the length of the switching element can be taken into account at the same time during the adjustment of the temperature switch, so that the switching behaviour of the temperature switch can be set more exactly by taking this production tolerance into account.

In the sense of the invention, the expression "essentially" means deviations from respectively exact values by +/−10%, preferably by +/−5% and/or deviations in the form of changes that are of no importance for the function.

Developments, advantages and use possibilities of the invention also result from the following description of exemplary embodiments and from the figure. All described and/or pictorially represented features are in principle the subject of the invention per se or in any desired combination, independently of their summarisation in the claims or back reference thereof. The content of the claims is also made a part of the description.

In the following, the invention is described in more detail on the basis of exemplary embodiments in connection with the figures.

DETAILED DESCRIPTION OF THE INVENTION

Figure 1:
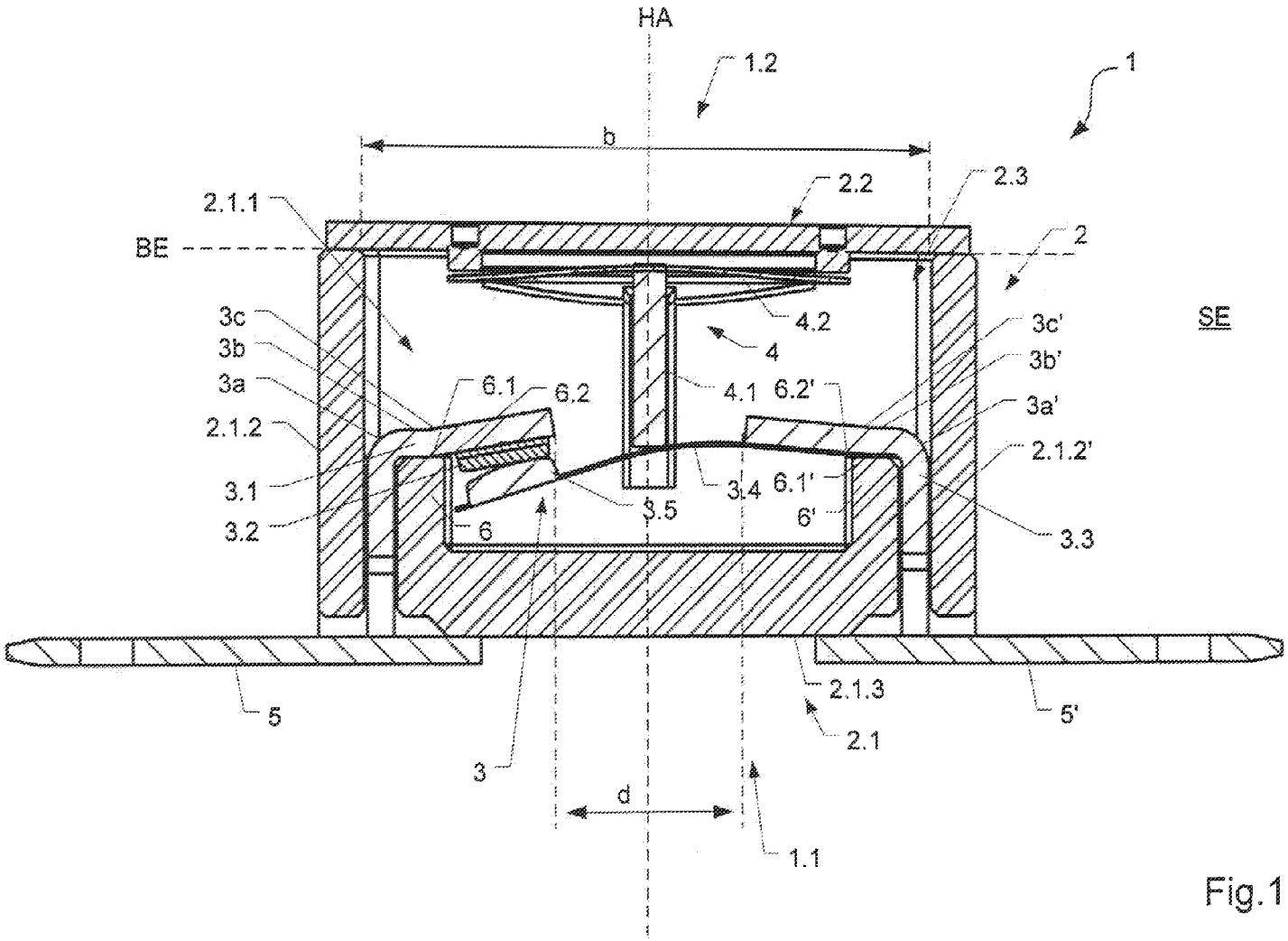
FIG. 1 by way of example shows a temperature switch according to the invention in a sectional illustration.

In FIG. 1, with the reference number 1 a temperature switch according to the invention is shown in a sectional illustration through the sectional plane SE. The temperature switch 1 has a housing 2 of closed construction, out of which contact elements 5, 5' are guided on the lower side 1.1 as contact element pair. A switching system 3 consisting of a first support 3.1 with a fixed contact 3.2 and a second support 3.3, on which a switch spring 3.4 with a switch contact 3.5 is arranged, is provided in the housing 2. Furthermore, a switching arrangement 4 is provided within the housing 2, which effects a positional change of the switch contact 3.5 as a function of the temperature. Here, the switching arrangement 4 acts on the switch spring 3.4 in particular and thereby effects a separation of the switch contact 3.5 from the fixed contact 3.2 by spacing these contacts with respect to one another.

The housing 2 formed from an electrically insulating material is of multi-part construction and essentially consists of a first housing section 2.1 having a housing opening 2.3 and a second housing section 2.2 closing the housing opening 2.3. The housing opening 2.3 is here provided on the upper side 1.2 of the temperature switch 1 opposite the contact elements 5, 5' and is closed by the second housing section 2.2, constructed in a lid-like manner. The first housing section 2.1 is constructed in a U-shaped or essentially U-shaped manner and has a base section 2.1.3, which forms the lower side 1.1 of the temperature switch 1. The base section 2.1.3 laterally merges into the side sections 2.1.2, 2.1.2', which in their longitudinal extent protrude with respect to the base section 2.1.3 in the direction of the vertical axis HA of the temperature switch 1. The free ends of the side sections 2.1.2, 2.1.2' located remotely from the base section 2.1.3 are constructed planarly, the planar sections of these free ends spanning a reference plane BE, which runs perpendicularly to the vertical axis HA. After the production or adjustment of the temperature switch, the second housing section 2.2 rests against these planar sections of the side sections 2.1.2, 2.1.2' by means of the outer edge thereof and is connected in these regions by adhesive bonding or welding to the first housing section 2.1. An interior 2.1.1 is formed in the housing 2 by means of the protrusion of the side sections 2.1.2, 2.1.2' with respect to the base section 2.1.3 and by means of the lid-shaped construction of the second housing section 2.2, in which interior the switching arrangement 4 or the switching system 3 is housed in a protected manner.

The supports 3.1, 3.3 are inserted into this interior 2.1.1 of the housing 2, specifically through passages 2.4, 2.4'. In their longitudinal extent, the passages 2.4, 2.4' here run parallel to the vertical axis HA and are provided in the region between the base section 2.1.3 and the side sections 2.1.2, 2.1.2'. The side section 2.1.2, 2.1.2' is constructed in a reinforced manner in the region of the passages 2.4, 2.4', i.e. it has a larger thickness of the wall. As a result, projections 6, 6' protruding into the interior 2.1.1 are formed, which in each case have an upper projection face 6.1, 6.1', which run parallel to the reference plane BE and perpendicularly to the vertical axis HA, respectively. The supports 3.1, 3.3 are designed in a strip-shaped manner and formed from an electrically conductive material. The supports 3.1, 3.3 are guided through the passages 2.4, 2.4' and shaped by bending in a permanently angled manner in a first bending region **3*a*, 3*a'*, specifically in such a manner that the section of the supports 3.1, 3.3 protruding into the interior 2.1.1 rests by means of its lower side facing the base section 2.1.3 against the projection face 6.1, 6.1' by means of an intermediate section 3***b*, 3*b'* in each case. The projections 6, 6' in each case additionally have a bending edge 6.2, 6.2', which are formed in the transition region between the respective projection face 6.1, 6.1' and an inner face section running parallel to the respective passages 2.4, 2.4'. In the region of the bending edge 6.2, 6.2', the supports 3.1, 3.3 are in turn permanently deformed or bent in the second bending region 3*c*, 3*c'*, specifically in such a manner that the supports 3.1, 3.3 are deformed in the two successive first and second bending regions 3*a*, 3*a'*, 3*c*, 3*c'* in different bending directions. Preferably, the supports 3.1, 3.3 are constructed in a bent manner in the first bending region 3*a*, 3*a'* by 90° or essentially by 90°, so that the support 3.1, 3.3 guided within the passages 2.4, 2.4' extends from a vertical course orientated parallel to the vertical axis HA after the bending region 3*a*, 3*a'* in the horizontal direction, i.e. parallel to the reference plane BE at least in certain sections by means of the intermediate section 3*b*, 3*b'* thereof. In the further, second bending region 3*c*, 3*c'*, the respective supports 3.1, 3.3 are bent by an acute angle, preferably by an angle α between 5 and 15°, this angle α being formed between the plane accommodating the respective projection face 6.1, 6.1' and the support 3.1, 3.3 and opening in the direction of the vertical axis HA. Here, it may be noted that the bending of the supports 3.1, 3.3 in the second bending region 3*c*, 3*c'* can be differently sized and in particular can be changed independently of one another in the adjustment method described in the following. By means of the previously described construction of the supports 3.1, 3.3, these supports protrude laterally into the interior 2.1.1 constructed in the housing 2 and form tongue-like bendable sections by means of the free-end side protruding ends. The bending in this case preferably takes place around the bending edges 6.2, 6.2'. The fixed contact 3.2 is provided on the lower side of the free-side end of the first support 3.1 facing the base section 2.1.3. The switch spring 3.4 is arranged on the lower side of the second support 3.3 likewise facing the base section 2.1.3, which extends beyond the free end protruding from the second support 3.3 to the first support 3.1 and is located with the switch contact 3.5 provided on the switch spring 3.4 in the region of the fixed contact 3.2.

In the exemplary embodiment shown, the contact elements 5, 5' are designed as separate elements, which are connected by means of conventional connection technologies, for example by welding or soldering to the supports 3.1, 3.3. Alternatively, the contact elements 5, 5' can be formed by the free-end sides of the first and second supports 3.1, 3.3, which protrude on the lower side with respect to the housing 2.

The temperature switch according to FIG. 1 is constructed as an "opener", i.e. in the rest state, the switch contact 3.5 rests against the fixed contact 3.2, so that the first support 3.1 is electrically connected to the second support 3.3 via the fixed contact 3.2, the switch contact 3.5 and the switch spring 3.4. A switching arrangement 4 is provided in the temperature switch 1, which acts on the switch spring 3.4 in such a manner that, if a defined temperature threshold is exceeded, the electrical contact is opened by lifting off the switch contact 3.5 from the fixed contact 3.2. The switching arrangement 4 is here formed in the exemplary embodiment shown by a switching element 4.1 formed in a rod-shaped manner and a bimetallic element 4.2. The switching element 4.1 is here formed from a non-conductive material. The bimetallic element 4.2 is in particular constructed as a bimetallic disc, which, if a certain temperature threshold is exceeded, implements a reshaping from a concave state, curved in the direction of the upper side 1.2, to a convex state, curved in the direction of the lower side 1.1. This reshaping here takes place suddenly in a snap movement, the positional change of the bimetallic element 4.2 in the central region thereof is transmitted via the switching element 4.1, which is arranged by means of the narrow side thereof in this central region of the bimetallic element 4.2, to the switch spring 3.4, against which the switching element 4.1 rests by means of the further, opposite narrow side.

The bimetallic element is arranged on the second housing section 2.2 and held by the same. The second housing section 2.2 accommodating the bimetallic element 4.2 is constructed from a material with high thermal conductivity and with low thermal mass, so that a good heat transfer, which is temporally delayed to the smallest extent possible, can take place between the second housing section 2.2 and the bimetallic element 4.2.

In the following, the adjustment of the temperature switch 1 shall be described on the basis of the FIGS. 2 and 3. The adjustment takes place here during the production of the temperature switch 1 before the closure of the housing opening 2.3 by means of the second housing section 2.2. The housing opening 2.3 is constructed in such a manner that adjustment and measurement means 10, 11, 12 can be introduced into the interior 2.1.1 from the upper side 1.2 of the temperature switch. The width b of the housing opening 2.3 is here dimensioned in such a manner that the same is larger than the distance d of the free ends of the supports 3.1, 3.3 from one another in the sectional plane SE accommodating the supports 3.1, 3.3. As a result, adjustment means 10, 11 can be positioned on the regions of the supports 3.1, 3.3 protruding over the bending edges 3.2, 3.2' and the positions of these sections are changed by bending around the bending edges 3.2, 3.2'.

Figure 2:
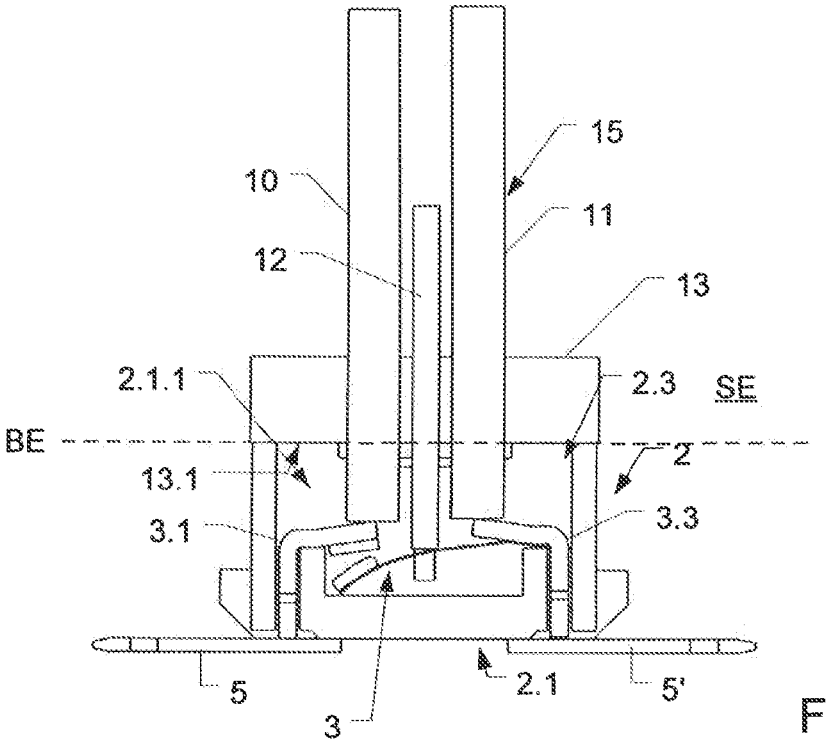
FIG. 2 by way of example shows a temperature switch measured by means of a measurement and adjustment arrangement in the case of an open electrical contact.
Figure 3:
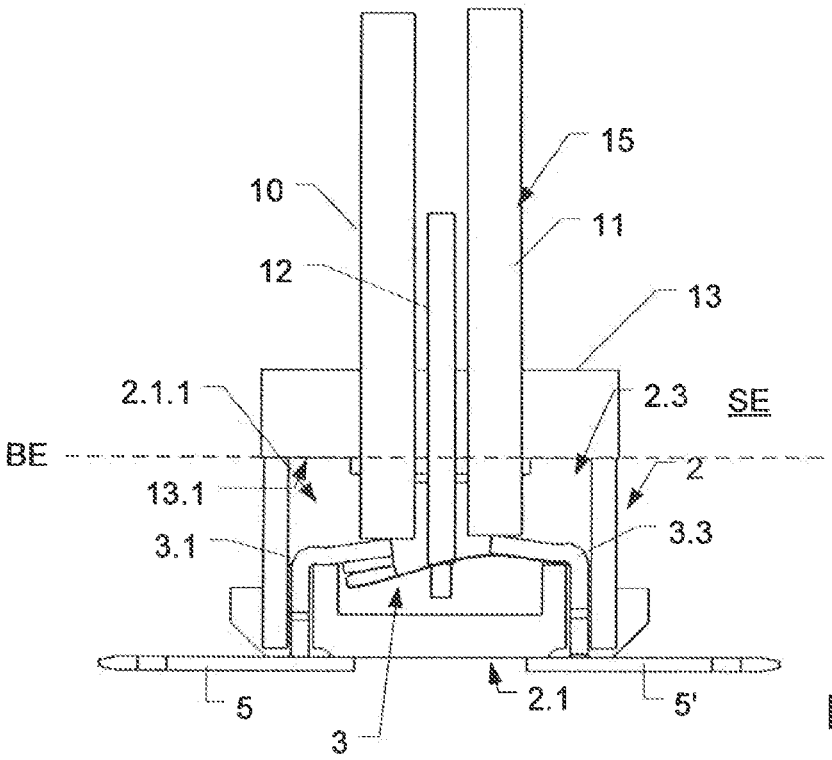
FIG. 3 by way of example shows a temperature switch measured by means of a measurement and adjustment arrangement in the case of a closed electrical contact.

The measurement and adjustment arrangement, designated in the FIGS. 2 and 3 with the reference number 15, has a first and second adjustment means 10, 11, which are constructed slidably in a direction parallel to the vertical axis HA of the temperature switch 1 and form bearing surfaces against the supports 3.1, 3.3 on the free ends introduced into the interior 2.1.1. A measurement means 12 is provided between the first and second adjustment means 10, 11, which is likewise constructed slidably in the direction of the vertical axis HA of the temperature switch 1 and is constructed for measuring the spring force of the switch spring 3.4 or for measuring the position of the switch spring. The sliding of the adjustment and measurement means 10, 11, 12 takes place relatively to a guide and bearing element 13. The measurement and adjustment arrangement 15 is introduced into the temperature switch 1, which is open at the upper side, in such a manner that the guide and bearing element 13 comes to lie in the reference plane BE by means of its lower side 13.1, i.e. rests in certain sections against the free ends of the side sections 2.1.2, 2.1.2'. In the following, the reference plane BE is used as reference plane for all measurement and adjustment steps. The aim of the previously described adjustment, inter alia, is to set the switch hysteresis of the temperature switch 1 in a targeted manner, the switch hysteresis being influenced decisively by the switch clearance, which results from the fact that the switching element is not clamped between the bimetallic element 4.2 and the switch spring 3.4 in the case of closed electrical contact between the switch contact 3.5 and the fixed contact 3.2, but rather rests against the switch spring by means of its own weight due to gravity, but is spaced from the bimetallic element 4.2 at the upper side, so that the bimetallic element 4.2 can deform slightly without a positional change of the switching element 4.1 resulting.

At the beginning of the adjustment of the temperature switch 1, the determination of the switching point, at which an opening of the electrical contact between the fixed contact 3.2 and the switch contact 3.5 can be measured, and the spring force of the switch spring 3.4, specifically both in the closed state of the contact and in the open state, takes place in a first step. Here, the measurement means is guided to the switch spring 3.4 and initially the spring force in the closed state of the contact is determined.

Subsequently, the pass of the measurement means 12, at which an opening of the electrical contact results, is determined by means of a continuity test between the contact elements 5, 5'. The pass is determined here with reference to the reference plane BE. Finally, in a further measurement step, the spring force of the switch spring in the case of an open electrical contact is measured in a further measurement step. To do this, the measurement means 12 is lowered yet further from the switching point, in order to reproduce the switching pass of the bimetallic element 4.2. This measured spring force for an open contact corresponds to the force, which acts on the bimetallic element 4.2 in the case of an open contact and as a result significantly influences the switch hysteresis of the temperature switch 1.

After determining the actual values of the spring forces or the switching point, the supports 3.1, 3.3 are bent iteratively in such a manner that the switching point, i.e. the opening of the electrical contact at a defined pass of the measurement means 12 with respect to the reference plane BE is reached and the spring forces in the closed state or in the open state also reach the desired values. The desired values depend substantially on the length of the switching element 4.1 to be used and are for example stored as a parameter set in the measurement and adjustment arrangement used. The spring forces in the closed or open contact state cannot be adjusted independently of one another. However, it is possible to set the spring force to a desired value in the case of an open contact thereby monitoring that the spring force lies in a reliable range in the case of a closed contact. As the spring force of the switch spring 3.4 acts on the bimetallic element 4.2 in the open contact state, the desired value of the spring force in the open contact state results from the desired switching temperature when closing the contact. After the first measurement of the temperature switch 1, the iterative adjustment takes place, the first and/or second support 3.1, 3.3 being bent by the first or second adjustment means 10, 11 around the bending edges 6.2, 6.2'. The bending initially takes place with a small increment, i.e. only a slight bending of the supports 3.1, 3.3, as too strong a bending of the supports 3.1, 3.3 cannot be reversed without manual intervention or without a relatively large outlay. Care is therefore to be taken, that the desired values for the switching point and the spring forces are achieved whilst complying with the predetermined bending direction in the direction of the base section 2.1.3. Following the first bending of the supports 3.1, 3.3, a new measurement of the switching point or the spring forces takes place in the closed or in the open state of the electrical contact. As a result, the completed adjustment procedure can be analysed on the basis of the change of the measured parameters and the degree of bending in the subsequent adjustment step, i.e. the adjustment increment or the support 3.1 or 3.3 to be bent can be determined therefrom. Here, the degree of bending of the respective supports 3.1, 3.3 in successive adjustment steps can be differently sized.

The adjustment can take place on a single, determined length of the switching element 4.1. However, it is also possible to undertake an adjustment in such a manner that the same takes place with respect to a switching element length to be chosen from a quantity of different, discrete switching element lengths, the chosen switching element length subsequently being used during the final assembly of the temperature switch 1. In addition, it is also possible that the measurement of the temperature switch 1 takes place using the switching element 4.1 to be installed in the same temperature switch 1. Here, the measurement means 12 can for example have a receptacle for the switching element 4.1. As a result, tolerances in the switching element length can already be taken into account during the adjustment and thus a more exact setting of the switching point can take place.

As the bending of the support 3.1, 3.3 effects a displacement of the bearing points of the fixed contact 3.2 with respect to the switch contact 3.5, one or both contact surfaces can be constructed convexly, so that the bending of the supports 3.1, 3.3 leads to tolerable displacements of the contact bearing points. As previously stated, the setting of the switching point takes place by bending the support 3.1, the spring force, which the switch spring 3.4 has both in the closed state and in the open state, also necessarily being changed at the same time. By bending the support 3.3, a setting of the spring force of the switch spring 3.4 or a compensation of the change of the spring force takes place, which change results during the setting of the switching point. Preferably, the corresponding bending of the supports 3.1 and 3.3 takes place simultaneously, specifically under constant measurement of the feed path of the switch spring 3.4 between opening and closing and also the spring force of the switch spring 3.4 using the probe- or rod-shaped measurement means 12.

The invention was previously described on the basis of an exemplary embodiment. It is understood that numerous modifications and changes are possible without departing from the inventive idea.

REFERENCE LIST

1 Temperature switch
1.1 Lower side
1.2 Upper side
2 Housing
2.1 First housing section
2.1.1 Interior
2.1.2, 2.1.2' Side section
2.1.3 Base section
2.2 Second housing section
2.3 Housing opening
2.4, 2.4' Passage
3 Switching system
3.1 First support
3.2 Fixed contact
3.3 Second support
3.4 Switch spring
3.5 Switch contact
3*a*, 3*a*' First bending region
3*b*, 3*b*' Intermediate section
3*c*, 3*c*' Second bending region
4 Switching arrangement
4.1 Switching element
4.2 Bimetallic element
5, 5' Contact element
6, 6' Projection
6.1, 6.1' Projection face

6.2, 6.2' Bending edge
10 First adjustment means
11 Second adjustment means
12 Measurement means
13 Guide and bearing element
13.1 Lower side
15 Measurement and adjustment arrangement
α Angle
b Width
d Distance
BE Reference plane
HA Vertical axis
SE Sectional plane

The invention claimed is:

1. A temperature switch, comprising
a housing (2),
a switching system (3) consisting of a first support (3.1) with a fixed contact (3.2) and a second support (3.3), on which a switch spring (3.4) with a switch contact (3.5) is arranged, and
a switching arrangement (4), which effects a positional change of the switch contact (3.5) as a function of the temperature,
wherein
the first and second supports (3.1, 3.3) are bendable,
the housing (2) is formed by at least one first housing section (2.1) having at least one housing opening (2.3) and a second housing section (2.2) closing the housing opening (2.3),
the first and second supports (3.1, 3.3) are accessible via the housing opening (2.3) by adjustment means (10, 11),
the housing opening (2.3) is at an end of the first housing section (2.1),
the first housing section (2.1) at least partially houses the switching arrangement (4),
the first and second supports (3.1, 3.3) extend laterally into an interior (2.1.1) in the first housing section (2.1),
the first housing section (2.1) has two side sections (2.1.2, 2.1.2') located opposite to each other, on which a projection (6, 6') is formed in each case, each projection having a projection face (6.1, 6.1') running essentially at a right angle to a vertical axis of the temperature switch (1), and
each of the first and second supports (3.1, 3.3) is angled in a first bending region (**3*a*, 3*a'*) and rests against one of the projection faces (6.1, 6.1') via an intermediate section (3*b*, 3*b'*) adjacent to the first bending region (3*a*, 3*a'***) via a wide side.

2. The temperature switch according to claim 1, characterised in that the switching arrangement (4) is formed by a switching element (4.1) and a shape changing bimetallic element (4.2).

3. The temperature switch according to claim 2, characterised in that the switching element (4.1) is in operative connection with the bimetallic element (4.2) and the switch spring (3.4) in such a manner that a positional change of the switch contact (3.5) takes place when the bimetallic element (4.2) is deformed.

4. The temperature switch according to claim 1, characterised in that the first housing section (2.1) is constructed in a U-shaped or essentially U-shaped manner.

5. The temperature switch according to claim 1, wherein each projection face (6.1, 6.1') has a bending edge (6.2, 6.2') thereon.

6. The temperature switch according to claim 1, characterised in that the first and second supports (3.1, 3.3) each are formed by a strip-shaped flat material with rectangular cross section with one pair of mutually opposing, spaced apart wide and narrow sides in each case.

7. The temperature switch according to claim 1, wherein each of the first and second supports (3.1, 3.3) has a second bending region (**3*c*, 3*c'*), in which the respective support (3.1, 3.3) is deformed in a bending direction different from the bending direction of the first bending region (3*a*, 3*a'***).

8. The temperature switch according to claim 5, wherein a distance (d) between two mutually opposite free ends of the supports (3.1, 3.3) is smaller than a width (b) of the housing opening (2.3) measured in a plane (SE) perpendicular to each of the bending edges (6.2, 6.2').

9. The temperature switch according to claim 1, wherein the switch contact (3.5) and/or the fixed contact (3.2) is constructed in a convexly curved manner on a contact surface therebetween.

10. A method for adjusting a temperature switch (1), comprising a housing (2), a switching system (3) consisting of a first support (3.1) with a fixed contact (3.2) and a second support (3.3), on which a switch spring (3.4) with a switch contact (3.5) is arranged, characterised in that a first adjustment means (10) acting on the first support (3.1) and a second adjustment means (11) acting on the second support (3.3) are introduced via a housing opening (2.3), in that at least one of the supports (3.1, 3.3) is bent in an adjustment step by force action of the adjustment means (10, 11) on these supports (3.1, 3.3) and the position and/or the spring force of the switch spring (3.4) is determined in a measurement step by a measurement means (12).

11. The method according to claim 10, wherein before the initial bending of the first or second support (3.1, 3.3), the position of the switch spring (3.4) at a switching point, at which a separation of the switch contact (3.5) from the fixed contact (3.2) takes place, is measured with reference to a reference plane by the measurement means (12).

12. The method according to claim 11, characterised in that the spring force exerted by the switch spring (3.4) onto the measurement means (12) is measured at the switching point and/or when the switch contact (3.5) rests against the fixed contact (3.2).

13. The method according to claim 10, wherein in the adjustment step, the bending of the first and/or second support (3.1, 3.3) around a bending edge (6.2, 6.2') takes place by lowering the respective adjustment means (10, 11) onto a section of the first and/or second support (3.1, 3.3) protruding over the bending edge (6.2, 6.2').

14. The method according to claim 10, characterised in that following one or a plurality of adjustment steps, a measurement step is carried out in each case for measuring the position of the switch spring (3.4) at the switching point and/or for measuring the spring force at the switching point and/or for measuring the spring force when the switch contact (3.5) rests against the fixed contact (3.2).

15. The method according to claim 10, characterised in that an iterative adjustment takes place by means of an alternating sequence of an adjustment step and a measurement step.

16. The method according to claim 10, characterised in that the bending of the at least one support (3.1, 3.3) in successive adjustment steps is differently sized.

17. The method according to claim 10, characterised in that the support(s) (3.1, 3.3) to be bent in the subsequent adjustment step and/or the degree of bending in the subsequent adjustment step are determined as a function of the change of the position of the switch spring (3.4) and/or the spring force at the switching point.

18. The method according to claim 10, characterised in that the adjustment of the temperature switch (1) takes place with respect to a switching element length chosen from a quantity of different, discrete switching element lengths.

19. The method according to one of claim 10, characterised in that the adjustment of the temperature switch (1) takes place by means of the action of the measurement means (12) on a switching element (4.1) located in the housing (2), wherein the switching element (4.1) acts on the switch spring (3.4).

* * * * *